US005735712A

United States Patent [19]

Haas et al.

[11] Patent Number: 5,735,712

[45] Date of Patent: Apr. 7, 1998

[54] SHIELDED CONNECTOR WITH CONDUTIVE GASKET INTERFACE

[75] Inventors: Orville A. Haas, Pocahontas, Ak.; Edward A. Karale, Fremont, Calif.

[73] Assignee: Regal Electronics, Inc., Santa Clara, Calif.

[21] Appl. No.: 816,876

[22] Filed: Mar. 13, 1997

Related U.S. Application Data

[63] Continuation-in-part of Ser. No. 526,991, Sep. 21, 1995, Pat. No. 5,647,765.

[51] Int. Cl.[6] ..... H01R 13/648

[52] U.S. Cl. ..... 439/609; 439/676

[58] Field of Search ..... 439/607, 608, 439/609, 610, 101, 108, 660, 676, 701, 709, 712

[56] References Cited

U.S. PATENT DOCUMENTS

| | | | |
|---|---|---|---|
| 4,703,991 | 11/1987 | Philippson | 439/676 |
| 5,112,251 | 5/1992 | Cesar | 439/607 |
| 5,158,480 | 10/1992 | Blondeel et al. | 439/607 |
| 5,169,346 | 12/1992 | Johnston | 439/676 |
| 5,178,563 | 1/1993 | Reed | 439/676 |
| 5,195,911 | 3/1993 | Murphy | 439/607 |
| 5,207,597 | 5/1993 | Kline et al. | 439/607 |
| 5,228,872 | 7/1993 | Liu | 439/607 |
| 5,281,169 | 1/1994 | Kiat et al. | 439/607 |
| 5,312,273 | 5/1994 | Andre et al. | 439/607 |
| 5,326,281 | 7/1994 | Yin | 439/607 |
| 5,348,484 | 9/1994 | Sorrentino | 439/101 |
| 5,378,172 | 1/1995 | Roberts | 439/607 |
| 5,382,182 | 1/1995 | Shen et al. | 439/676 |
| 5,397,250 | 3/1995 | Briones | 439/620 |
| 5,445,542 | 8/1995 | Serizay | 439/609 |
| 5,647,765 | 7/1997 | Haas et al. | 439/609 |

FOREIGN PATENT DOCUMENTS

WO 90/16096 12/1990 WIPO .

*Primary Examiner*—Hien Vu

*Attorney, Agent, or Firm*—Thomas E. Schatzel; Law Offices of Thomas E. Schatzel A Prof. Corporation

[57] ABSTRACT

A modular jack for interfacing a modular plug with a printed circuit board. The jack has a first outer housing segment and a second outer housing segment with a plurality of contacts embedded within the second segment and having pin portions projecting therefrom about one terminal end and contact portions projecting therefrom about the other terminal end with the contact portions being insertable within the first housing segment to make interface contact and mating with a male plug. The modular jack includes a shield with an electrically conductive compliant member about the edge of the shield to make interface electrical connection with a panel when the modular jack is mounted in place with the compliant member clamped by a plurality of clamps aligned with edges of the shield.

4 Claims, 2 Drawing Sheets

SHIELDED CONNECTOR WITH CONDUTIVE GASKET INTERFACE

This is a continuation-in-part of Ser. No. 08/526,991, filed Sep. 21, 1995, now U.S. Pat. No. 5,647,765.

BACKGROUND OF THE INVENTION

1. Field of the Invention

This invention relates to electrical connectors and more particularly to shielded connector assemblies providing protection against electromagnetic interference, radio frequency interference, and the like.

2. Description of the Prior Art

Shielded electrical jack connector systems are used in many applications, e.g. telecommunications equipment, computers, other digital information systems, etc. Such jack connectors are commonly mounted on the surface of printed circuit boards which include ground planes or ground circuits. The electrical circuitry connected with such jack connectors commonly include mateable male plugs mounted to a plurality of electrical cables having a plurality of electrically conductive leads surrounded by an electrically conductive shield and which are respectively connected to terminals in the plug. It is commonly necessary to shield the circuits carrying signals to avoid unwanted electromagnetic interference generated from within and/or outside the system.

One type of electrical connector is a telecommunication rectangular shielded electrical connector assembly which includes a rectangular shaped dielectric housing with outer surfaces covered at least in part by a metal shield with walls covering outside surfaces of the housing. An illustrative example is shown in U.S. Pat. No. 5,281,169.

A shortcoming of prior art shielded electrical connector assemblies is encountered with panel mounted connectors and resultant electrical contact with the panel. In such applications, the connector is mounted on a printed circuit board such that a wall of the shield lies just beyond the edge of the printed circuit board. Then, the printed circuit board is positioned with its forward edge against the rear face of a metal panel, e.g. an external panel of an electronic apparatus such as a computer. In such applications, it is common for the wall of the shield to protrude through a rectangular hole in the panel to enable the connector to receive a shielded data-link plug to connect the apparatus to a peripheral electronic apparatus. However, shortcomings are commonly encountered with the electrical contact between the shield and the panel.

SUMMARY OF THE PRESENT INVENTION

An object of the present invention is to provide a modular jack that assures electrical contact between the jack and a panel to provide a ground path therebetween.

Another object of the present invention is to provide a shielded modular jack that provides for flexible electrical contact between the jack and a panel.

Another object of the present invention is to provide a shielded modular jack that provides for flexible electrical contact between the jack and a panel and which is economical to manufacture.

A preferred embodiment of the present invention includes a modular jack connector having a first outer housing segment of a nonconductive dielectric material and formed by opposed top and bottom walls and opposed side walls, said top, bottom and side walls being integrally formed and defining an interior longitudinally extending cavity between them for creating a forward female plug receptacle space. A second outer housing segment formed by a block of nonconductive dielectric material is fixed about said top wall and said bottom wall. A plurality of jack contacts, with each of the jack contacts including a pin portion, a contact portion, and an interconnecting portion interconnecting said pin and contact portion are mounted to the second outer housing segment. The interconnecting portions are embedded in and extend from a first end to a second end of the second outer housing segment and said pin portions project from said first end and said contact portions project from said second end. The contact portions extend transversely from the second outer housing segment with said contact portion positioned within said forward plug receptacle cavity and in position to electrically interface and mate with a compatible plug inserted in the cavity. A metal shield covers outside wall surfaces of the first outer housing segment, and an electrically conductive compliant member is adhered to the first peripherals edge of the shield and positioned to make electrical contact with the shield and a panel when the connector is mounted adjacent to the panel.

In another embodiment designed to simultaneously accommodate a plurality of plugs, the first housing segment includes a partition wall extending transversely through said space and between said opposed side walls and projecting upwardly from said bottom wall and dividing said longitudinal cavity into multiple forward plug receptacle spaces bounded by said top, said bottom, said partition and said side walls.

Improvement of transfer impedance of a shielded connector, requires that the inductance and discontinuities be reduced to low values over a wide range of frequencies. For optimum shield performance, all connecting parts should make complete homogenous contact or bonding between each part. With a continuous connection applying constant pressure at all points, the inductance of the interconnect is decreased. The preferred embodiments incorporate an electrically conductive compliance member which may include a compliant foam, e.g. thermoplastic rubber, covered by a conductive fabric, e.g. woven strands of nickel coated copper wire; or an electrically conductive elastomer that is flexible and compressible. The electrically conductive compliant member extends about the peripheral edge of the shield to form a continuous connection between the connector shield and the mating panel or enclosure. The method of fastening the compliant member to the connector is by mechanical clamping comprising clamps integrally formed within the shield and set back from said peripheral edge of the shield. The clamps provide alignment of the gasket during assembly while penetrating lips of clamps provide a clamping secure interface with the compliant member to simultaneously provide secure clamping and electrical bonding of the parts. As a result, uniform electrical connection is made when the clamps are bent over and interface the compliant member against the surface of the connector shield and the clamp. To further enhance the electrical interface, spring tabs may project from a bottom edge of shield to make direct mechanical contact with an edge of the mount panel.

During installation of the connector into a metal panel cutout, the electrically conductive gasket surfaces at the front edge of the connector tend to retract towards the rear of the connector body and are firmly compressed against the inside wall surface of the panel cutout. This forms an electrically low impedance seal or bond around the perimeter of the connector and panel cutout. This increases the total contact surface. Since the gasket is both compliant and forgiving, it takes on the shape of any irregular surfaces of the shield and/or opening in the panel.

An advantage of the present invention is that it provides a modular jack that assures electrical contact between the jack and a panel to provide a ground path therebetween.

Another advantage of the present invention is that it provides a shielded modular jack that provides flexible electric contact between the jack and a panel.

Another advantage of the present invention is that it provides a shielded modular jack which is economical to manufacture.

These and other objects and advantages of the present invention will no doubt become obvious to those of ordinary skill in the art after having read the following detailed description of the preferred embodiments.

IN THE DRAWINGS

DETAILED DESCRIPTION OF THE PREFERRED EMBODIMENT

Figures 1, 2, 3, 4, 5, 6, 7:
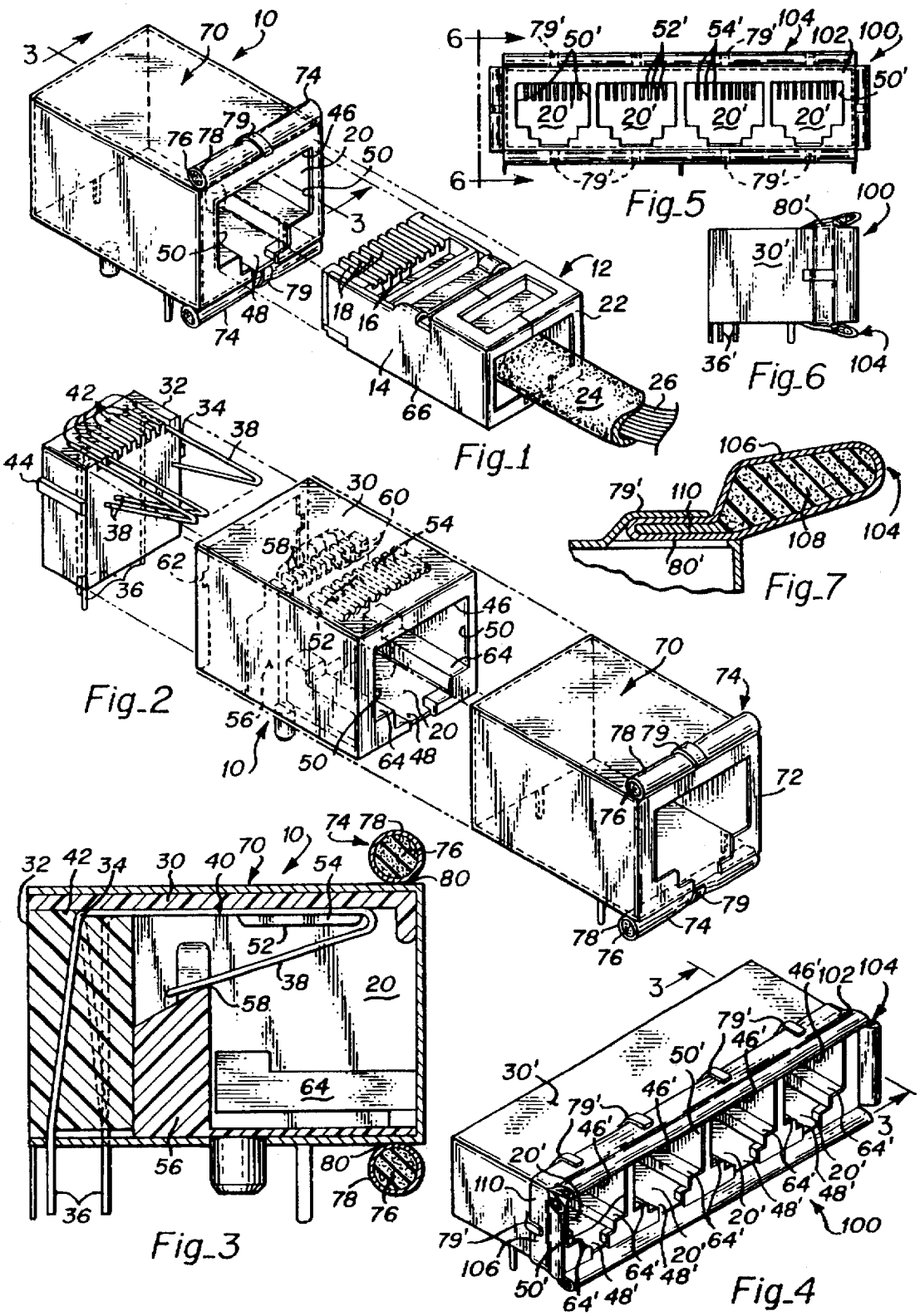
FIG. 1 is a perspective view of a modular jack connector of the present invention aligned to receive a RJ-45 type plug.
FIG. 2 is an exploded view of the jack connector of FIG. 1.
FIG. 3 is a cross-sectional view of the jack connector of FIG. 1 taken along the lines 3—3.
FIG. 4 is a perspective view of an alternative embodiment of the present invention in the form of a modular jack connector for receiving multiple plugs.
FIG. 5 is a front planar view of the connector of FIG. 4.
FIG. 6 is a side planar view of the connector of FIG. 4.
FIG. 7 is an enlarged, cross-sectional view of the electrically conductive compliant member of the connector of FIG. 4.

FIGS. 1–3 illustrate a modular jack connector of the present invention and is referred to by the general reference character 10. As illustrated in FIG. 1, the modular jack connector 10 is adapted to receive a plug, e.g. RJ-45 plug referred to by the general reference character 12. The plug 12 includes a dielectric housing 14 mounting a plurality of terminals 16 disposed within discrete slots 18 in the housing 14. The housing 14 is dimensioned for insertion into a plug receiving cavity 20 of the modular jack connector 10. The plug 12 further includes an external metallic shield 22 which is in electrical contact with a shield 24 surrounding a cable 26. In particular, the cable 26 includes a plurality of leads which are electrically connected to the terminals 16. The electrically conductive shield 24 is in the form of a braid or foil extending around the leads 26.

The modular jack electrical connector assembly 10 defines a female electrical connector having a first nonconductive outer housing segment 30 of dielectric material and a second outer housing segment 32 of dielectric material which slides within the housing segment 30. Embedded within the segment 32 is a plurality of jack contacts 34 which are formed from a wire, e.g. substantially of rectangular cross-section. Each of the jack contacts 34 has a pin portion 36 for mounting to a printed circuit board to make electrical connection to conductive areas on the printed circuit board. Each jack contact 34 further includes a contact portion 38 with an interconnection portion 40 interconnecting the pin portion 36 to the contact portion 38. The interconnection portion 40 is bent at approximately right angles at the point wherein the portion 40 projects from the outer housing segment 32 and extends within a slot 42 formed in the top surface of segment 32. Thus, the jack contacts 34 project from segment 32 and slide within the interior of the segment 30. The segment 32 further includes a pair of ribs 44 projecting from each side surface.

The first outer housing segment 30 includes a top wall 46, a bottom wall 48 and a pair of side walls 50 to form the cavity 20 which serves as a plug receiving opening (data-link plug receptacle). The cavity 20 is dimensioned so as to be compatible to receive the plug 12. About the top wall 46 are formed a plurality of slots 52 intermediate adjacent ribs 54. Thus, each of the interconnection pin portions 40 of the jack contacts 34 slide through the slots 52 and are electrically insulated and physically separated from adjacent jack contacts 34. Also supported between the side walls 50 within the cavity 20, and adjacent to the segment 32, is a pin contact support bridge 56. The bridge 56 forms a plurality of slots 58 formed intermediate adjacent ribs 60. Each of the slots 58 are in alignment with one of the slots 52 such that the terminal end of each of the contact portions 38 rest upon the bridge 56 and are electrically can physically insulated from the adjoining contact 38.

Thus, when the plug 12 is inserted within the connector 10, each of the contacts 38 is in alignment with contacts 16 of the plug 12. As the plug 12 is inserted within the cavity 20, electrical contact is made between each of the aligned contacts. The contact portions 38, being bent over the interconnection portion 40 and resting on the bridge 56 have a spring-like relationship and thus make frictional contact with the contacts on the plug 18 and when the plug 12 is removed, the contacts 38 rest against the bridge 56.

Also, to aid assembly, the segment 30 includes a slot 62 in each of the side walls 50 with the slot 62 in alignment with the rail 44 of the segment 32. Thus, the segment 32 may be slid within the cavity 20 from the rear side with the rails 44 in place in slots 62.

The bottom wall 48 of the segment 30 includes ledges 64 to be compatible and mate with a bottom surface 66 of the plug 12.

To provide electromagnetic shielding of the electrical connector assembly 10, a stamped metallic shield, referred to by the general reference character 70, is placed over the segment 30. The shield 70 is a generally rectangular conductive material which is disposed about the segment 30 and defines a peripheral envelope with a front face 72 to integrally mate with the configuration of the face about the cavity 20. About the edge of the face 72 is an electrically conductive compliant member, referred to by the general reference character 74, and having a compliant foam core 76 surrounded by a conductive fabric 78. The electrically conductive compliant member 74 is secured to the shield 70 by a plurality of metallic hooks 79 projecting from the shield 70 and an adhesive 80. Thus, when the electrical connector assembly 30 is mounted in place on a metal panel, the electrically conductive compliant member makes electrical contact with the panel and simultaneously makes electrical contact with the shield 70 so as to provide a continuous electrical circuit path to the ground reference. With the shield 70 positioned within the interior of a panel and the face 72 penetrating an opening in such panel, the member 74 is simultaneously compressed against the wall of the panel about edges forming such opening and the shield 70. Thus, the member 74 takes shape to conform to irregularities in the opening while making continuous electrical contact.

FIGS. 4–7 illustrate an alternative embodiment of the present invention in the form of a multiple modular electrical connector assembly and referred to by the general reference character 100. Those common components of assembly 10, have the same reference number characterized by a prime designation. The assembly 100 includes a plurality of the assemblies 10 joined in unison to form multiple cavities 20' and to receive multiple plugs 12. The assembly 100 is internally the same as the unit 10 such that FIG. 3 is a proper illustrative cross-sectional diagram along the lines 3—3 of FIG. 4.

In the assembly 100, the side walls 50' intermediate the individual cavities 20' further serve as a partition wall to divide the individual cavities 20'. In the assembly 100, the shielding comprises a metallic face plate 102 about the openings of the cavities 20' with an electrically conductive compliant member, referred to by the general reference character 104 adhered thereto and to the housing segment 30' by means of the adhesive 80' and the metallic hooks 79' bent over from the face 102. Thus, there is electrical circuitry between the metallic face plate 102 and electrically conductive compliant member 104. With the module 100 mounted about an opening in a panel, the electrically conductive compliant member 104 makes continuous contact with the edge of the panel about the entire periphery. Being compliant, the member 104 accommodates irregularities in the surface of the edge of the opening as well as any irregularities in the plate 102 to assure the continuous electrical contact.

FIG. 7 illustrates the electrically conductive compliant member 104 in greater detail. The member 104 includes a fabric material 106, e.g. woven strands of nickel coated copper wire, about a compliant core material 108, e.g. thermoplastic rubber, projecting from a ridge carrier 110, e.g. polypropylene. The adhesive 80' makes a narrow strip to adhere to the peripheral edge of the housing segment 30' and the hooks 79' make further mechanical fastening of the member 104 to the shield 102.

When installing the assemblies 10 or 100 into a panel, the assembly 10 and/or 100 is installed from the rear of the panel such that as the face of the connector 100 protrude through the opening in the panel, the compliant members 74 and 104 are compressed about the edge of the opening therefore making continuous contact with the edge of the panel while also being compressed to increase the surface area of contact with the shield 70 and/or shield face 102.

Figure 8:
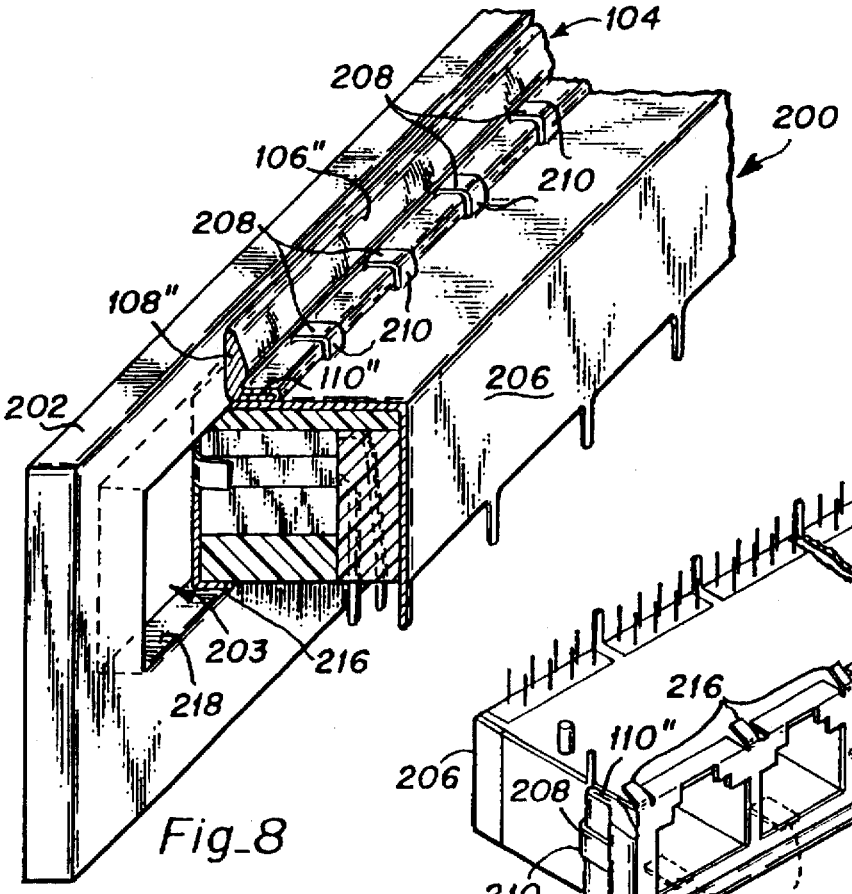
FIG. 8 is a perspective, partially sectioned view of an alternative embodiment of the present invention illustrating an electrically conductive member clamped directly to a conductive shield of the connector and with tabs of the shield making additional electrical and mechanical contact with a panel.
Figure 9:
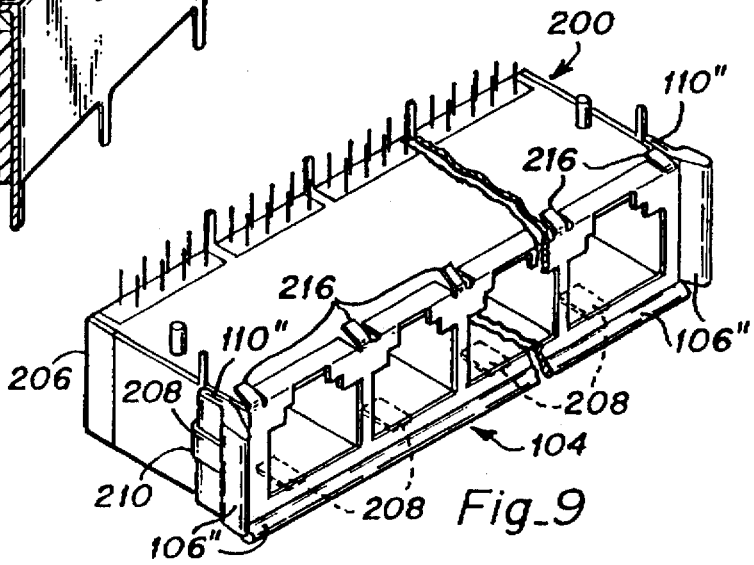
FIG. 9 is a bottom perspective view of the connector of FIG. 8.

FIG. 8 is a perspective, partially sectioned view of an alternative embodiment of the present invention in the form of a multiple modular electrical connector assembly and referred to by the general reference character 200. FIG. 9 is a bottom perspective view of the connector assembly 200. Those common components to assembly 100 carry the same reference number characterized by a double prime designation. The connector 200 is mounted to a panel 202 about an opening 203 and carries a compliant member 204 in the form of an electrically conductive elastomer that is flexible and compressible. The member 204 is engaged about the edge of three sides of the connector 200. As illustrated in FIGS. 8 and 9, the member 204 is electrically and physically secured to a metallic shield 206 by a plurality of aligned clamps 208 forming a U-shaped opening having a back wall 210, a top wall 212 and a front jaw tooth 214. The back walls 210 are aligned in a line parallel to the front edge of the shield 206 and form a guiding edge to receive and align the member 204 during assembly. Once the member 204 is aligned, the clamps 208 are compressed such that the front jaw teeth 214 bite into the compliant member 204 to make electrical and mechanical securement. Thus, the clamps 208 anchor the compliant member 204 to the shield 206 while permitting the free end of the compliant member 204 to pivot about the jaw teeth 214. The clamps 208 are spaced such that at least one clamp 208 is positioned in alignment with each cavity 20". Also, there is at least one clamp 208 about each vertical side wall of the shield 206.

About the bottom from edge of the shield 206, a plurality of spring tabs 216 project to make direct mechanical and electrical contact with an edge 218 of the panel 202 about opening 203. The tabs 216 are an integral part of the shield 206 and immediately adjacent the front edge of the shield 203 such that when the connector 200 is positioned in the opening 203, the tabs 216 engage the edge 218 of the panel 202 while the compliant member 204 makes electrical contact to the panel about the other three edges of the opening 203. Preferably, there is a tab 216 aligned with each wall 50".

Figure 10:
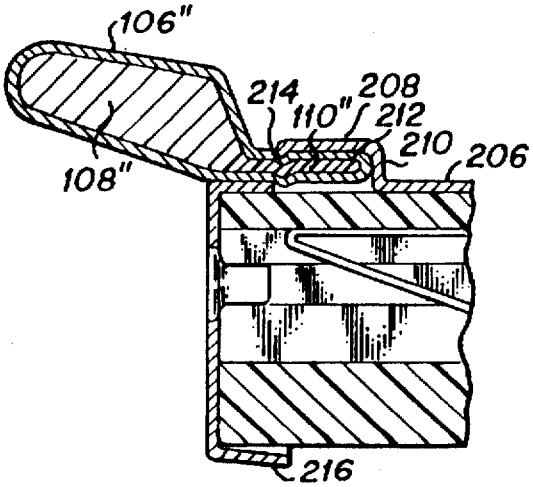
FIG. 10 is a cross-sectional view of a segment of FIG. 9 taken along the lines 10—10.

As illustrated in FIGS. 8 and 10, the rigid carrier 110" serves as a stiffener and edge to align the back edge of the compliant member 106" with the back walls 210 of the clamps 208. The back walls 210 are set back from the front edge of the shield 206 so as to allow the connector 200 to fit within the opening 203 and flush with the front face of the panel.

Figure 11:
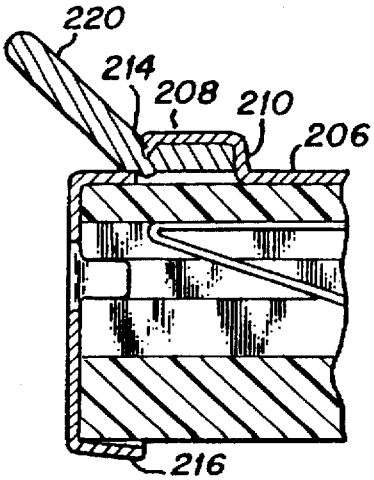
FIG. 11 is a cross-sectional view of a segment of an alternative electrically conductive compliant member of a connector of FIG. 8.

In assembling connectors to printed circuit boards, the pins 36 penetrate the printed circuit board and then are processed through a solder bath which is at an extremely high temperature. During such processing, the front bottom edge of the shield 206 is in immediate vicinity of the solder bath and thus exposed to such heat. Consequently, it is beneficial to delete the compliant member 204 from such bottom edge because it may be adversely effected by the heat. However, the metallic tabs 216 can withstand such temperatures. For example, the shield 206 and tabs 216 may comprise a copper alloy plated with tin. Also, there are electrically conductive elastometer materials which may be used as the compliant material. Such materials can include silicon or neoprene with filler particles of silver, copper, aluminum, nickel or other conductive materials. Such materials may be made in the form of a rectangular strip 220 and mounted to the shield 206 with the clamps 208 aligning and securing the strips in place as illustrated in FIG. 11.

Although the present invention has been described in terms of the presently preferred embodiments, it is to be understood that the disclosure is not to be interpreted as limiting. Various alterations and modifications will no doubt become apparent to those skilled in the art after having read the above disclosure. Accordingly, it is intended that the appended claims be interpreted as covering all alterations and modifications as fall within the true spirit and scope of the invention.

We claim:

1. A modular jack (10) for connection to a printed circuit board and receipt of a modular plug (12), comprising:

an outer housing (30, 32) comprised of an electrically insulative material having an opposed top wall (46), bottom wall (48), side walls (50), and a back wall segment (32) being integrally formed and defining an interior longitudinally extending cavity (20) between them, said cavity forming an externally extending opening about a front end of the housing for receipt of a plug having electrical contacts;

a plurality of jack contacts (34), each of the jack contacts (34) including a pin portion (36), a contact portion (38) and an interconnecting portion (40) interconnecting said pin portion (36) and contact portion, said contact portion (36) being within said cavity (20) and said pin portion extending externally to the housing for mounting on a printed circuit board;

an electrically conductive shield member (206) engaged to an exterior surface of the outer housing (30, 32) about said opening;

an electrically conductive compliant member (204, 220) extending about an external edge of the shield member and in electrical connection with the shield member, such that when the housing (30, 32) is positioned on an electrically conductive panel (202) and said front end is positioned about an opening (203) of said panel, the electrically conductive compliant member (204, 202) makes electrical contact with said panel to create an electrically conductive path between the shield member (206), the compliant member and said panel; and a plurality of clamps (208) offset from a front edge of the shield member (206) and aligned in a line parallel to said front edge, said clamps (208) forming a U-shaped opening having a back wall (210), a top wall and a front jaw tooth (214) with said tooth (214) compressed against the compliant member (204, 220).

2. The modular jack of claim 1 wherein, the electrically conductive compliant member includes a compliant foam core (108") surrounded by a conductive fabric (106") and a rigid carrier (110") interfaced with said clamps (208) to anchor the compliant member to the shield member (206).

3. The modular jack of claim 1 further including, a plurality of conductive spring tabs (216) about a bottom front edge of the shield (206) to interface and make frictional contact with an edge of a panel (203).

4. The modular jack of claim 3 wherein, the electrically conductive compliant member (204) includes a compliant foam core (108") surrounded by a conductive fabric (106") and a rigid carrier (110") interfaced with said clamps (208) to anchor the compliant member (204) to the shield member (206).

* * * * *

UNITED STATES PATENT AND TRADEMARK OFFICE

CERTIFICATE OF CORRECTION

PATENT NO. : 5,735,712

DATED : April 7, 1998

INVENTOR(S) : Orville A. Haas and Edward A. Karale

It is certified that error appears in the above-indentified patent and that said Letters Patent is hereby corrected as shown below:

On the title page, Item [54],
Title should read:

SHIELDED CONNECTOR WITH CONDUCTIVE GASKET INTERFACE

Signed and Sealed this

Eleventh Day of August 1998

Bruce Lehman

*Attest:*

BRUCE LEHMAN

*Attesting Officer*

*Commissioner of Patents and Trademarks*